US006326451B1

(12) United States Patent
Hamada et al.

(10) Patent No.: US 6,326,451 B1
(45) Date of Patent: Dec. 4, 2001

(54) ACRYLONITRILE-BASED PRECURSOR FIBER FOR THE FORMATION OF CARBON FIBER, PROCESS FOR PREPARING SAME, AND CARBON FORMED FROM SAME

(75) Inventors: Mitsuo Hamada; Yoshihiko Hosako; Teruyuki Yamada; Tatsuzi Shimizu, all of Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 09/513,201

(22) Filed: Feb. 25, 2000

Related U.S. Application Data

(63) Continuation of application No. PCT/JP98/03765, filed on Aug. 25, 1998.

(30) Foreign Application Priority Data

Aug. 27, 1997 (JP) ..... 9-231472

(51) Int. Cl.[7] ..... C08F 220/46; D02G 3/00

(52) U.S. Cl. ..... 526/342; 428/364; 428/367; 526/234; 526/307; 526/317.1; 526/341

(58) Field of Search ..... 526/342, 341, 526/234; 428/364, 367

(56) References Cited

U.S. PATENT DOCUMENTS

| | | | | |
|---|---|---|---|---|
| 3,650,668 | * | 3/1972 | Riggs | 8/115.5 |
| 4,831,069 | * | 5/1989 | Sugimori | 524/232 |
| 5,413,858 | * | 5/1995 | Hajikamo | 428/364 |

FOREIGN PATENT DOCUMENTS

| | | |
|---|---|---|
| 1 465 729 | 3/1977 | (GB) . |
| 53-119325 | 10/1978 | (JP) . |
| 60-167931 | 8/1985 | (JP) . |
| 04-257313 | 9/1992 | (JP) . |
| 05-132813 | 5/1993 | (JP) . |
| 9-503249 | 3/1997 | (JP) . |

OTHER PUBLICATIONS

Kenichi Morita et al, Chemical Abstracts, vol. 78, No. 6, 1973, Abstract No. 31291k, Carbon Fiber, XP002163255.
Koji Terada et al, Chemical Abstracts, vol. 79, No. 24, Dec. 17, 1973, Abstract No. 137875q, Carbon fiber from acrylonitrile fiber., XP002163256.

* cited by examiner

*Primary Examiner*—Fred Zitomer
(74) *Attorney, Agent, or Firm*—Oblon, Spivak, McClelland, Maier & Neustadt, P.C.

(57) ABSTRACT

This invention relates to an acrylonitrile-based precursor fiber for the formation of a carbon fiber which is obtained by spinning an acrylonitrile-based copolymer (which contains not less than 90% by weight of acrylonitrile units as monomeric components, contains $5.0\times10^{-5}$ to $2.0\times10^{-4}$ equivalent/g of carboxylic acid groups and not less than $0.5\times10^{-5}$ equivalent/g of sulfate groups and/or sulfonic groups, and has protons and/or ammonium ions as counter ions to the carboxylic acid groups, sulfate groups and sulfonic groups) and treating the resulting coagulated filament, wherein the amount of iodine adsorbable to the acrylonitrile-based precursor fiber is not greater than 0.8% by weight based on the weight of the fiber. By using this precursor fiber, a carbon fiber having a high strength and a high elastic modulus can be easily formed.

24 Claims, 1 Drawing Sheet

ACRYLONITRILE-BASED PRECURSOR FIBER FOR THE FORMATION OF CARBON FIBER, PROCESS FOR PREPARING SAME, AND CARBON FORMED FROM SAME

This application is a Continuation (CIP) Of International Application Number PCT/JP98/03765, filed Aug. 25, 1998.

TECHNICAL FIELD

This invention relates to acrylonitrile-based precursor fibers for the formation of carbon fibers. More particularly, it relates to highly dense acrylonitrile-based precursor fibers suitable for the formation of carbon fibers having high strength and high modulus.

BACKGROUND ART

Conventionally, carbon fibers and graphite fibers (herein referred to collectively as "carbon fibers") formed by using acrylonitrile-based fibers as precursors have excellent mechanical properties and are hence being used as fibrous reinforcements in high-performance composite materials for use in a wide range of applications including aerospace applications, as well as sports and leisure applications. In order to enhance the performance of such composite materials, it is desired to further improve the quality and performance of carbon fibers. At the same time, it is expected to reduce the production cost of carbon fibers and thereby expand their use to industrial material applications.

In contrast to acrylic fibers for clothing use, acrylonitrile-based fibers for use as precursors of carbon fibers are no more than intermediate products for the formation of carbon fibers as final products. Accordingly, it is not only desirable to provide acrylonitrile-based fibers capable of yielding carbon fibers having excellent quality and performance, but it is also very important that the acrylonitrile-based fibers have good stability during spinning of precursor fibers, exhibit high productivity in the stabilization step for forming carbon fibers, and can be provided at low cost.

From this point of view, a large number of propositions have been made in order to provide acrylonitrile-based fibers capable of yielding carbon fibers having high strength and high elasticity. These propositions include, for example, an increase in the polymerization degree of the starting polymer, and a decrease in the content of copolymerized components other than acrylonitrile. As to the spinning method, dry jet wet spinning is commonly employed.

However, when the content of copolymerized components other than acrylonitrile is decreased, the solubility of the resulting polymer in solvents is generally reduced. This not only detracts from the stability of the spinning solution, but also coagulated filament is voidful, making it difficult to form precursor fibers stably. These problems have been overcome by employing the dry jet wet spinning process.

Since the dry jet wet spinning process comprises extruding a polymer solution through a nozzle into air and then passing it continuously through a coagulating bath to form filaments, it is easy to obtain dense coagulated filaments. On the other hand, a decrease in the pitch of nozzle holes will cause a problem in that adjacent filaments may adhere to each other. Thus, there is a limit to the number of nozzle holes.

As contrasted with the dry jet wet spinning process, the wet spinning process commonly used for the production of acrylic fibers can provide such a high coagulation rate that nozzle holes can be arranged at a higher density.

Accordingly, the wet spinning process has superiority from the viewpoint of productivity. For this reason, it has been eagerly desired to provide acrylonitrile-based precursor fibers which can be prepared by the wet spinning process and are suitable for the formation of high-performance carbon fibers.

However, the bundle of fibers obtained by the wet spinning process generally include many broken fibers and much fuzz. Moreover, this spinning process is characterized in that the resulting precursor fibers have a low tensile strength and a low elastic modulus, and in that the fiber structure of the precursor fibers is less dense and has a low degree of orientation of molecular chain. Consequently, the mechanical properties of the carbon fibers obtained by stabilizing them are generally unsatisfactory.

Accordingly, a number of methods for densifying the fiber structure while employing the wet spinning process have been disclosed up to the present.

For example, Japanese Patent Publication No. 39494/'79 discloses a method for forming a highly dense acrylonitrile-based fiber according to a wet spinning process using a non-aqueous organic solvent as the coagulant. However, this method is not economical in that a non-aqueous organic solvent is used in the coagulating bath.

Japanese Patent Laid-Open No. 214518/'83 discloses a precursor fiber characterized by the structure of the fiber and, in particular, the thickness of the skin layer, with the main purpose of improving its processability in the stabilization step and the quality of the resulting carbon fiber. However, no consideration is given to the polymer composition and the coagulated filament structure which are important factors governing the structure of the fiber. Accordingly, this precursor fiber is unsatisfactory from the viewpoint of improvement of the performance of the carbon fiber.

Furthermore, with respect to the acrylonitrile-based polymer used as the starting material for the formation of acrylonitrile-based precursor fibers, due consideration must be given not only to its formability into fibers, but also to complicated thermochemical reactions taking place in the stabilization step.

That is, in order to produce carbon fibers having excellent quality and performance at lower cost, it is desirable that, when acrylonitrile-based precursor fibers are converted to a carbonaceous structure by stabilization heat treatment, they scarcely produce pyrolyzates which may cause fusing of the fibers and a reduction in the performance of the resulting carbon fibers, and they have thermal reaction characteristics which permit this conversion to be effected by stabilization for a short period of time.

Since the conversion of acrylonitrile-based fibers to carbon fibers involves drastic physical and chemical changes, the causal relationship between them is quite indistinct. Although extensive investigations have been made in order to elucidate them theoretically, many problems still remain unsolved in the present situation.

There are few investigations which quantitatively show, from an industrial point of view, what is the suitable composition of the acrylonitrile-based polymer basically constituting acrylonitrile-based precursor fibers.

The findings of previous propositions can be summarized as follows. It is preferable that an acrylonitrile-based polymer for the formation of a carbon fiber precursor have a composition in which acrylonitrile units are contained in a proportion above a certain limit (not less than about 90% by weight). In order to allow precursor fibers to pass through the stabilization step in a short period of time, it is effective to introduce suitable reaction-initiating groups, i.e., functional groups accelerating the cyclic condensation reaction of the nitrile group (e.g., carboxyl groups). In addition to these conditions, other comonomers may be added in order to facilitate the formation of precursor fibers.

For example, when a polymer having a high content of acrylonitrile units in the polymer composition is used, its solubility in solvents is reduced. Consequently, the method for forming precursor fibers is very limited and, moreover, the concentration of the spinning solution is very low. Thus, this polymer is less than satisfactory from the viewpoint of carbon fiber performance and spinning formability.

When the contents of copolymerized components are increased to extend latitude in spinning-forming, precursor fibers formed from this polymer tend to fuse together during stabilization heat treatment and, moreover, show a reduction in carbonization yield. Thus, this polymer is still unsatisfactory from the viewpoint of processability in the stabilization step and the quality and performance of the carbon fibers.

In order to overcome these various problems and, at the same time, suggest the composition of starting polymers which can be fired and carbonized in a short period of time or are advantageous for this purpose, the following propositions have been made.

For example, there have been proposed a process wherein an improvement in stabilization rate and carbonization yield is achieved by using a polymer composition having high reactivity for cyclization and oxidation in the stabilization (Japanese Patent Publication No. 33019/'72); a process wherein the polymer composition is specified (e.g., by the use of a vinyl carboxylate monomer) so as to reduce the stabilization time with consideration for stability in the polymer preparation and spinning steps (Japanese Patent Laid-Open No. 7209/'76); and a process wherein an amine salt or a peroxide is added to the starting polymer (Japanese Patent Publication No. 7209/'76 and Japanese Patent Laid-Open No. 87120/'73).

However, all of these patents simply present a broad range of constitution with respect to the polymer composition (i.e., the types and contents of the copolymerized monomers), and cannot possibly be said to disclose a well-defined composition which satisfactorily exhibits the properties (e.g., the behavior of stabilization) required of precursor fibers. Moreover, although the acceleration of the stabilization reaction itself is believed to enable high line-speed, this rather tends to detract from the performance of the resulting carbon fibers. Thus, it is impossible to achieve an improvement in both the productivity and the performance of carbon fibers. Furthermore, the addition of an amine or a peroxide to the polymer exerts various adverse effects on the stability of the spinning solution and the precursor fibers, and cannot be regarded as an industrially excellent method.

Meanwhile, Japanese Patent Laid-Open No. 34027/'77 discloses a process wherein a high-performance carbon fiber can be economically and stably produced by specifying the composition of a polymer and modifying the conditions of stabilization treatment. In particular, it is worth noting that the combined use of (meth)acrylamide and a carboxyl-containing monomer is uniquely effective in accelerating the stabilization reaction.

Moreover, Japanese Patent Laid-Open No. 339813/'93 proposes a process wherein a highly dense acrylonitrile-based precursor fiber is obtained by controlling the composition of a copolymer comprising acrylonitrile, acrylamide and methacrylic acid, and subjecting this copolymer to wet spinning. This proposition has made it possible to make up for the shortcomings of conventional wet spinning processes. However, this acrylonitrile-based precursor fiber is still unsatisfactory for the purpose of producing a carbon fiber having higher performance.

Thus, although many processes have heretofore been proposed, there has not yet been obtained an acrylonitrile-based precursor fiber for the formation of a carbon fiber which has high productivity and can yield a high-performance carbon fiber. In particular, many propositions on the composition of an acrylonitrile-based polymer have been made in order to carry out the stabilization reaction efficiently in the stabilization step, whereas no attempt to control the fiber structure in the coagulating step governing the fiber structure and thereby obtain an acrylonitrile-based precursor fiber for the formation of a high-performance carbon fiber has been proposed in the present situation.

DISCLOSURE OF THE INVENTION

In view of these problems of the prior art, the present inventors made an intensive investigation on the densification and homogenization of the structure of precursor fibers, and have now completed the present invention. That is, an object of the present invention is to provide an acrylonitrile-based precursor fiber for the formation of a carbon fiber which, as a result of densification and homogenization of its fiber structure, can easily yield a carbon fiber having a high strength and a high elastic modulus, as well as a highly economical process for preparing the same.

The present invention relates to an acrylonitrile-based precursor fiber for the formation of a carbon fiber which is obtained by spinning an acrylonitrile-based copolymer to form a coagulated filament, and treating the coagulated filament, wherein the acrylonitrile-based copolymer is a copolymer containing not less than 90% by weight of acrylonitrile units as monomeric components, containing $5.0\times10^{-5}$ to $2.0\times10^{-4}$ equivalent/g of carboxylic acid groups and not less than $0.5\times10^{-5}$ equivalent/g of sulfate groups and/or sulfonic groups, and having protons and/or ammonium ions as counter ions to the carboxylic acid groups, sulfate groups and sulfonic groups; and the amount of iodine adsorbable to the acrylonitrile-based precursor fiber for the formation of a carbon fiber is not greater than 0.8% by weight based on the weight of the fiber.

The present invention also relates to a process for preparing an acrylonitrile-based precursor fiber for the formation of a carbon fiber which comprises the steps of providing a spinning solution comprising an acrylonitrile-based copolymer dissolved in a solvent, the acrylonitrile-based copolymer containing not less than 90% by weight of acrylonitrile units as monomeric components, containing $5.0\times10^{-5}$ to $2.0\times10^{-4}$ equivalent/g of carboxylic acid groups and not less than $0.5\times10^{-5}$ equivalent/g of sulfate groups and/or sulfonic groups, and having protons and/or ammonium ions as counter ions to the carboxylic acid groups, sulfate groups and sulfonic groups; extruding the spinning solution into a coagulating bath to form a coagulated filament, or extruding the spinning solution into air and then passing it through a coagulating bath to form a coagulated filament; washing the coagulated filament, drying it, and densifying it by drying; and drawing the densified filament again.

In order to decrease the number of defect sites appearing in the resulting carbon fibers due to copolymerized components and thereby improve the quality and performance of the carbon fibers, the acrylonitrile-based copolymer used in the present invention needs to contain not less than 90% by weight, preferably not less than 96% by weight, of acrylonitrile units.

Moreover, the acrylonitrile-based copolymer used in the present invention preferably contains not less than 1% by weight of acrylamide units for the following reason. As to the stabilization reactivity in the stabilization step, and the rate of the thermal cyclization reaction, the content of carboxylic acid groups is a dominant factor as will be described later. However, the coexistence of a small amount of acrylamide increases them sharply. If the content of acrylamide in the copolymer is less than 1% by weight, the effect of accelerating the thermal cyclization reaction will not be distinctly exhibited. Moreover, the presence of acrylamide serves to improve the solubility of the copolymer in solvents and enhance the denseness of solidified filaments formed by wet spinning or dry jet wet spinning. As to the denseness of solidified filaments, sulfate groups or sulfonic groups constitute a dominant factor as will be described later. However, the presence of acrylamide makes it possible to form denser solidified filaments. Although the upper limit of the acrylamide content is not specifically defined, it is preferably less than 4% by weight.

In the present invention, the carboxylic acid groups present in the polymer play a role in enhancing the stabilization reactivity in the stabilization step, while they constitute defect sites in the resulting carbon fibers. Consequently, this is an important factor which should be controlled so as to lie at the optimum level. That is, if the content of carboxylic acid groups is less than $5.0\times10^{-5}$ equivalent/g, the stabilization reactivity in the stabilization step will be so low that a further treatment at higher temperatures will be required. Such treatment at higher temperatures tends to cause runaway reactions, making it difficult to achieve stable traveling properties in the stabilization step. This is rather uneconomical in that stabilization must be carried out at a lower speed in order to suppress such runaway reactions.

On the other hand, if the content of carboxylic acid groups is greater than $2.0\times10^{-4}$ equivalent/g, the cyclization reaction of nitrile groups in the polymer will be accelerated. Consequently, the oxidation reaction does not proceed to the interior of the fibers, so that only the region adjacent to the surface of the fibers is made flameproof. Under this situation, however, the central portion of the fibers in which a stabilization structure is underdeveloped cannot be prevented from being decomposed in the succeeding carbonization step at a higher temperature, resulting in a marked reduction in the performance (in particular, elastic modulus in tension) of the carbon fibers.

In the practice of the present invention, the introduction of carboxylic acid groups into the acrylonitrile-based copolymer can readily be accomplished by copolymerizing a vinyl monomer having a carboxyl group, such as acrylic acid, methacrylic acid, itaconic acid, maleic acid, fumaric acid or crotonic acid, with acrylonitrile and other monomeric components. Among them, acrylic acid, methacrylic acid and itaconic acid are preferred.

In the present invention, the sulfate groups and/or sulfonic groups play an important role in controlling the denseness of the precursor fibers. If the content of sulfate groups and/or sulfonic groups is less than $0.5\times 10^{-5}$ equivalent/g, the solidified filaments tend to have a fiber structure full of voids, resulting in a reduction in the performance of the final carbon fibers. In order to suppress this tendency, it is preferable that the acrylonitrile-based copolymer contain not less than $1.0\times10^{-5}$ equivalent/g of sulfate groups and/or sulfonic groups. On the other hand, the upper limit of the content of sulfate groups and/or sulfonic groups is not specifically defined. However, where sulfate groups and/or sulfonic groups are introduced by copolymerizing a monomer having such a functional group as described below, the content of comonomers is increased more than necessary to provide defect sites, with the undesirable result that the performance of the carbon fibers is reduced. Accordingly, it is preferable that the content of sulfate groups and/or sulfonic groups in the copolymer be less than $4.0\times10^{-5}$ equivalent/g.

In the practice of the present invention, sulfate groups and/or sulfonic groups may be introduced either by copolymerizing acrylonitrile with a sulfonic group-containing vinyl monomer selected from allylsulfonic acid, methallylsulfonic acid, p-styrenesulfonic acid, vinylsulfonic acid, sulfoalkyl acrylates, sulfoalkyl methacrylates, acrylamide alkanesulfonic acid and ammonium salts thereof; or by using a initiator comprising a combination of persulfate/sulfite or ammonium salts thereof to introduce sulfate groups and/or sulfonic groups to the polymer ends. If desired, both methods may be employed in combination.

The counter ions to the aforesaid sulfate groups, sulfonic groups and carboxylic acid groups are preferably protons or ammonium ions. The reason for this is that, if alkali metals such as sodium and potassium are used, they tend to remain in the carbon fibers even after stabilization, resulting in a reduction in the performance (i.e., strength) of the carbon fibers.

In addition to acrylonitrile, acrylamide, and the aforesaid carboxyl-containing vinyl monomers and sulfonic group-containing vinyl monomers, the acrylonitrile-based copolymer used in the present invention may also contain small amounts of other monomers to such an extent as to meet the requirements of the present invention. Such monomers include, for example, esters of vinyl-containing carboxylic acids (e.g., acrylic acid, methacrylic acid, itaconic acid, maleic acid, fumaric acid and crotonic acid), vinyl acetate, vinyl propionate, methacrylamide, diacetone acrylamide, maleic anhydride, methacrylonitrile, styrene and α-methylstyrene.

In order to prepare an acrylonitrile-based copolymer from these monomers, there may be employed any of well-known polymerization techniques such as solution polymerization and suspension polymerization. Where solution polymerization is employed, an azo initiator or an organic peroxide initiator is used. However, since these initiators fail to introduce sulfate groups and/or sulfonic groups into the polymer, any of the aforesaid monomers containing a sulfate group and/or a sulfonic group must be copolymerized in a required amount.

Also in the case of suspension polymerization in which an initiator as described above is used, a monomer containing a sulfate group and/or a sulfonic group needs to be copolymerized. However, when a redox initiator such as a combination of persulfuric acid/sulfurous acid, chloric acid/sulfurous acid, or ammonium salts thereof is used, sulfate groups and/or sulfonic groups are introduced into the polymer, so that the polymer of the present invention can be efficiently prepared.

It is preferable to remove unreacted monomers, polymerization initiator residues and other impurities from the resulting copolymer to the utmost. From the viewpoint of stretchability in spinning of the precursor fibers and manifestation of the performance of the carbon fibers, the polymerization degree of the copolymer should preferably be such that its intrinsic viscosity [η] is not less than 1.0 and more preferably not less than 1.4. Usually, a copolymer having an intrinsic viscosity [η] of not greater than 2.0 is used.

Next, the copolymer thus obtained is dissolved in a solvent to prepare a spinning solution. Usable solvents include organic solvents such as dimethylacetamide, dimethyl sulfoxide and dimethylformamide; and aqueous solutions of inorganic compounds such as zinc chloride and sodium thiocyanate. However, organic solvents are preferred in that no metallic compound is contained in the fibers and, therefore, the process is simplified. Among others, dimethylacetamide is most preferred because it can yield highly dense coagulated filaments.

In order to obtain dense coagulated filaments by spinning, it is preferable to use, as the spinning solution, a polymer solution having a polymer concentration above a certain limit. The polymer concentration is preferably not less than 17% by weight and more preferably not less than 19% by weight. Usually, polymer concentrations of not greater than 25% by weight are preferred.

As the spinning process, both dry jet wet spinning and wet spinning may be employed. However, the wet spinning process having high productivity is especially preferred from an industrial point of view.

Spinning is carried out by extruding the spinning solution through nozzle holes having a circular cross section into a coagulating bath to form coagulated filaments (wet spinning), or by extruding the spinning solution into air and then passing it through a coagulating bath to form coagulated filaments (dry jet wet spinning). According to the polymer concentration and the stretch ratio, the spinning draft should be suitably determined so as to yield fibers having a desired denier.

If the denseness or homogeneity of the fiber structure of precursor fibers is insufficient, defect sites will appear during stabilization and detract from the performance of the resulting carbon fibers. Accordingly, the properties of the coagulated filaments are very important in forming dense and homogeneous precursor fibers. In the present invention, it is preferable that the coagulated filaments have a porosity of not greater than 50%.

Porosity is an index to the homogeneity of the coagulated filaments. If the porosity is not greater than 50%, the pores present in the coagulated filaments are sufficiently uniform. An investigation conducted by the present inventors has revealed that, when the porosity of coagulated filaments in accordance with the present invention is not greater than 50%, there is a close correlation between porosity and average pore radius as shown in FIG. 1. However, if the porosity exceeds 55%, the correlation between porosity and average pore radius is lost, and only the average pore radius is increased. This indicates that the proportion of pores having larger radii is increased as the porosity becomes greater, and is considered to suggest that the coagulated filaments becomes inhomogeneous.

Moreover, it is preferable that the coagulated filaments are transparent and not devitrified. One cause of devitrification of the coagulated filaments is the formation of macrovoids, and another is spinning in an aqueous coagulating bath using dimethylformamide or dimethyl sulfoxide as the solvent, rather than the formation of macrovoids. Devitrification can be prevented by introducing a hydrophilic monomer into the acrylonitrile-based polymer or by using dimethylacetamide as the solvent of the spinning solution and the solvent of the coagulating bath. Preferably, the coagulated filaments contain less than one macrovoid in a 1 mm length of the filament.

As used herein, the term "macrovoids" refers generically to spherical, fusiform and cylindrical interstices having a maximum diameter of 0.1 to several micrometers. The coagulated filaments in accordance with the present invention are free of such macrovoids and are formed by sufficiently uniform coagulation. The presence or absence of macrovoids can be easily examined by observing coagulated filaments directly under an optical microscope.

The properties of the coagulated filaments formed from the aforesaid spinning solution in the present invention can be controlled by regulating the conditions of the coagulating bath. An aqueous solution containing the solvent used for the spinning solution is preferably used as the coagulating bath, and the concentration of the contained solvent is adjusted so that the porosity of the coagulated filaments will be not greater than 50%. The concentration of the solvent generally varies according to the solvent used. For example, when dimethylacetamide is used, its concentration is in the range of 50 to 80% by weight and preferably 60 to 75% by weight.

Preferably, the temperature of the coagulating bath is as low as possible. It is usually 50° C. or below and preferably 40° C. or below. Denser coagulated filaments can be obtained as the temperature of the coagulating bath becomes lower. However, since unduly low temperatures cause a reduction in the take-up speed of the coagulated filaments and hence in productivity, the temperature of the coagulating bath should desirably be determined so as to fall within an appropriate range.

Next, the coagulated filaments are washed and drawn (namely, stretched) prior to densification by drying. No particular limitation is placed on the manner of washing and drawing. It is possible to carry out drawing after washing, or washing after drawing, or washing and drawing at the same time. As to the drawing method, in-bath drawing is usually employed. This in-bath drawing may be carried out by drawing the coagulated filaments directly in the coagulating bath or a drawing bath, or by drawing the coagulated filaments partially in air and then drawing them in a bath. The in-bath drawing is usually carried out in a drawing bath having a temperature of 50 to 98° C., either in a single stage or in two or more stages. The coagulated filaments may be washed before or after the in-bath drawing or at the same time as the in-bath drawing. As a result of these operations, the coagulated filaments are preferably stretched about 4 times or more in length before completion of the in-bath drawing. Moreover, in-air drawing, in-solvent drawing and the like may be employed to such an extent as not to interfere with the objects of the present invention.

The drawn and washed fibers are treated with a spin finish agents in the well-known manner. Although no particular limitation is placed on the type of the spin finish agents, it is preferable to use an aminosilicone type surface-active agent.

After treatment with the spin finish agents, the fibers are densified by drying. This densification by drying needs to be carried out at a temperature higher than the glass transition temperature of the fibers. In practice, however, this temperature may vary as the fibers are either in a hydrous state or in a dry state. The densification by drying is preferably carried out with a heating roller having a temperature of about 100 to 200° C.

In the practice of the present invention, it is important to draw the fibers again (hereinafter referred to as postdrawing) after densification by drying. This postdrawing may be carried out according to any of various methods including, for example, dry heat drawing with a heating roller, hot plate or heating pin having a high temperature, and steam drawing with pressurized steam. The stretch ratio is preferably not less than 1.1 and more preferably not less than 1.5.

This postdrawing is particularly effective in reducing the iodine adsorption of the precursor fibers. That is, the iodine adsorption of the precursor fibers can be easily reduced to not greater than 0.8% by weight based on the weight of the fibers. As used herein, the term "iodine adsorption" refers to the amount of iodine adsorbable to a fiber when the fiber is soaked in an iodine solution, and constitutes an index to the degree of denseness of the fiber structure. Smaller values indicates that the fiber is denser.

Furthermore, it is preferable that the precursor fibers of the present invention have a substantially circular cross section. The term "substantially circular" means that the cross section has no constricted part, and comprehends elliptical shapes in which the ratio of the major axis to the minor axis is not greater than 1.2 and preferably not greater than 1.1. When the precursor fibers having such a cross-sectional shape are used in the stabilization step, they are uniformly flameproofed and carbonized in the cross-sectional directions of the fibers, so that carbon fibers having higher performance can be obtained. A substantially circular cross section can be produced by using dimethylacetamide as the solvent of the spinning solution and, moreover, controlling the concentration of dimethylacetamide in the coagulating bath so as to be in the range of 60 to 75% by weight.

Thereafter, the fibers are subjected to a relaxation treatment as required. Thus, there are obtained precursor fibers in accordance with the present invention.

BEST MODE FOR CARRYING OUT THE INVENTION

The present invention is more specifically described with reference to the following examples. In these examples, all percentages are by weight.

(a) Copolymer Composition

The contents of various monomers (i.e., acrylamide, methyl acrylate, ammonium styrenesulfonate, sodium styrenesulfonate and carboxyl-containing monomers) in a copolymer were determined by $^1$H-NMR spectroscopy (with a Nihon Denshi Model GSZ-400 Superconducting FT-NMR).

(b) Intrinsic Viscosity [η] of Copolymer

The Intrinsic viscosity [η] of a copolymer was measured by a dimethylformamide solution at 25° C.

(c) Porosity and Average Pore Radius of Coagulated Filaments

A sample of filaments emerging from the coagulating bath and the drawing bath was taken, washed with water, and freeze-dried with liquid nitrogen to fix its structure. About 0.2 g of the dried sample was accurately weighed and placed in a dilatometer. Then, using a mercury injection device, the vessel was evacuated (to a vacuum of 0.05 torr or less) and filled with mercury. Thereafter, a measurement was made with a porosimeter. Thus, the pore volume was determined from the amount of mercury having penetrated thereinto. Pressure was applied up to a maximum of 3,000 bars. The porosity was determined according to the following equation.

$$\text{Porosity}=V/(V+M)$$

where M is the volume of the sample and V is the pore volume.

The average pore radius was calculated as follows. Pore radii at varying pressures were calculated according to the following equation to determine a distribution of pore volumes and pore radii at varying distribution. Then, the average pore radius was determined.

$$\text{Pore radius } (r)=-2\sigma \cos \theta/p$$

wherein σ: surface tension of mercury (480 dyn/cm)

θ: contact angle (140°)

p: pressure (d) Determination of Carboxylic Acid Groups and Sulfate Groups and/or Sulfonic Groups The content of carboxylic acid groups was determined by $^1$H-NMR spectroscopy as described above in (a).

The content of sulfate groups and/or sulfonic groups was determined by passing a 2% dimethylformamide solution of a copolymer through a mixed anion-cation exchange resin to remove ionized impurities, passing it through a cation exchange resin to convert the ions of the strongly acid groups to a free acid type, and then measuring the number of equivalents of all strongly acid groups per gram of the copolymer by potentiometric titration.

(e) Strand Strength and Elastic Modulus of Carbon Fibers

The strand strength and elastic modulus of carbon fibers were measured according to the method described in JIS R 7601.

(f) Iodine Adsorption

Two grams of precursor fibers were weighed out and placed in a 100 ml Erlenmeyer flask. After 100 ml of an iodine solution (prepared by dissolving 100 g of potassium iodide, 90 g of acetic acid, 10 g of 2,4-dichlorophenol, and 50 g of iodine in distilled water enough to make a total volume of 1,000 ml) was added thereto, the flask was shaken at 60° C. for 50 minutes to carry out an iodine adsorption treatment. Thereafter, the fibers having undergone the adsorption treatment was washed with ion-exchanged water for 30 minutes, further washed with distilled water, and then dewatered by centrifugation. The dewatered fibers were placed in a 300 ml beaker. After the addition of 200 ml of dimethyl sulfoxide, the fibers were dissolved therein at 60° C.

The amount of iodine adsorbed was determined by subjecting this solution to potentiometric titration using a N/100 aqueous solution of silver nitrate.

EXAMPLE 1

A mixture of acrylonitrile (hereinafter abbreviated as AN), acrylamide (hereinafter abbreviated as AAm), methacrylic acid (hereinafter abbreviated as MAA), ammonium styrenesulfonate (hereinafter abbreviated as ST-$NH_4$), distilled water, dimethylacetamide and a polymerization initiator (i.e., azobisisobutyronitrile) was fed to an overflow type polymerization vessel in a fixed amount per minute, during which it was maintained at 65° C. with stirring. The overflowing polymer slurry was washed and dried to obtain an acrylonitrile-based copolymer.

Its composition was such that AN/AAm/MAA/ST-$NH_4$= 96.1/2.7/0.6/0.6 (%). Moreover, the intrinsic viscosity [η] of the copolymer was 1.7. Furthermore, the content of carboxylic acid groups in this acrylonitrile-based copolymer was $7.5\times10^{-5}$ equivalent/g, and the content of sulfate groups and/or sulfonic groups therein was $3.2\times10^{-5}$ equivalent/g.

This acrylonitrile-based copolymer was dissolved in dimethylacetamide to prepare a spinning solution (having a polymer concentration of 21% and a solution temperature of 70° C.).

Using a spinneret having 3,000 holes with a diameter of 0.075 mm, this spinning solution was extruded into an aqueous solution of dimethylacetamide having a concentration of 70% and a bath temperature of 35° C. Thus, there were obtained transparent coagulated filaments free of macrovoids. Their porosity was 35%. Moreover, these coagulated filaments were drawn in air at a stretch ratio of 1.5, and further drawn in warm water at a stretch ratio of 3.4 to wash and desolvate them. Thereafter, they were dipped into a solution of a spin finish agents containing silicone oil, and densified by drying over a heating roller at 140° C.

Subsequently, they were drawn on a hot plate having a temperature of 180° C. at a stretch ratio of 1.5, and wound up at a speed of 77 m per minute to obtain 1.1 denier precursor fibers having a circular cross section. The iodine adsorption of the resulting precursor fibers was 0.32%.

Using a hot-air circulation oven, these fibers were treated in air at 230–260° C. under a 5% stretch for 50 minutes to form flameproof fibers. Subsequently, these fibers were subjected to a low-temperature heat treatment in an atmosphere of nitrogen at a maximum temperature of 600° C. under a 5% stretch for 1.5 minutes. Then, using a high-temperature heat treatment oven having a maximum temperature of 1,200° C., they were further treated in the same atmosphere under a −4% stretch for about 1.5 minutes. The resulting carbon fibers had a strand strength of 510 kg/mm$^2$ and a strand elastic modulus of 26.3 tons/mm$^2$.

EXAMPLE 2

By carrying out polymerization in the same manner as in Example 1, a polymer having the composition shown in Table 1 and an intrinsic viscosity [η] of 1.8 was obtained. This polymer was spun into 1.1 denier fibers and fired in the same manner as in Example 1.

When the coagulated filaments were observed under an optical microscope, they were transparent and free of macrovoids. Moreover, the resulting precursor fibers had a circular cross section. Their iodine adsorption, the porosity of the coagulated filaments, and the strand performance of the resulting carbon fibers are as shown in Table 2.

EXAMPLE 3

A mixture of AN, AAm, MAA, distilled water and polymerization initiators (i.e., ammonium persulfate, ammonium hydrogen sulfite and sulfuric acid) was fed to an overflow type polymerization vessel in a fixed amount per minute, during which it was maintained at 50° C. with stirring. The overflowing polymer slurry was washed and dried to obtain an acrylonitrile-based copolymer. The composition of this copolymer, its content of carboxylic acid groups, and its content of sulfate groups and/or sulfonic groups are shown in Table 1. The intrinsic viscosity [η] of this copolymer was 1.7.

Under the same conditions as employed in Example 1, this copolymer was spun by wet spinning to obtain transparent coagulated filaments free of macrovoids. Thereafter, they were post-treated in the same manner as in Example 1 to obtain 1.1 denier precursor fibers having a circular cross section.

Subsequently, these precursor fibers were stabilized and carbonized in the same manner as in Example 1. The strand performance of the resulting carbon fibers is shown in Table 2.

EXAMPLE 4

By carrying out polymerization in the same manner as in Example 3, a polymer having the composition shown in Table 1 and an intrinsic viscosity [η] of 1.7 was obtained. This polymer was spun, stabilized and carbonized in the same manner as in Example 3. Similarly to Example 3, the resulting coagulated filaments were transparent and free of macrovoids. Moreover, the resulting precursor fibers had a circular cross section. Their iodine adsorption, the porosity of the coagulated filaments, and the strand performance of the resulting carbon fibers are as shown in Table 2.

EXAMPLE 5

The acrylonitrile-based copolymer used in Example 3 was dissolved in dimethylacetamide to prepare a spinning solution (having a polymer concentration of 22% and a solution temperature of 70° C.).

Using a spinneret having 3,000 holes with a diameter of 0.15 mm, this spinning solution was spun by dry jet wet spinning. Specifically, coagulated filaments were formed by extruding the spinning solution through an air gap of 5 mm into an aqueous solution of dimethylacetamide having a concentration of 70% and a bath temperature of 20° C. These coagulated filaments were transparent, homogeneous and free of macrovoids. Their porosity was 28%.

Moreover, these coagulated filaments were drawn in air at a stretch ratio of 1.2, and further drawn in boiling water at a stretch ratio of 4 to wash and desolvate them. Thereafter, they were dipped into a solution of a spin finish agents containing silicone oil, and densified by drying over a heating roller at 140° C. Subsequently, they were drawn between drying rolls having a temperature of 180° C. at a stretch ratio of 1.70, and wound up at a speed of 160 m per minute to obtain 1.1 denier precursor fibers having a circular cross section.

Using a hot-air circulation oven, these fibers were treated in air at 230–260° C. under a 5% stretch for 50 minutes to form flameproof fibers having a fiber density of 1.36 g/cm$^3$. Subsequently, these fibers were subjected to a low-temperature heat treatment in an atmosphere of nitrogen at a maximum temperature of 600° C. under a 5% stretch for 1.5 minutes. Then, using a high-temperature heat treatment oven having a maximum temperature of 1,400° C., they were further treated in the same atmosphere under a −5% stretch for about 1.5 minutes. The resulting carbon fibers had a strand strength of 550 kg/mm$^2$ and a strand elastic modulus of 27.3 tons/mm$^2$.

EXAMPLE 6

The copolymer and spinning solution used in this example were similar to those of Example 3. The spinning solution was spun in the same manner as in Example 3, and the resulting coagulated filaments were washed, drawn, treated with a spin finish agents, and densified by drying. The fibers densified by drying were drawn in pressurized steam having a pressure of 2.5 kg/cm$^2$ at a stretch ratio of 3.3, dried again, and wound up at a speed of 110 m per minute to obtain 1.1 denier precursor fibers having a circular cross section.

These fibers were fired in the same manner as in Example 3 to obtain carbon fibers. Their performance is shown in Table 2.

EXAMPLE 7

Using the copolymer obtained in Example 3, a spinning solution similar to that of Example 3 was prepared.

Using a spinneret having 3,000 holes with a diameter of 0.075 mm, this spinning solution was extruded into an aqueous solution of dimethylacetamide having a concentration of 65% and a bath temperature of 35° C. to obtain transparent coagulated filaments free of macrovoids. Their porosity was 45%. Moreover, these coagulated filaments were treated in the same manner as in Example 1 to obtain 1.1 denier precursor fibers having a circular cross section. The iodine adsorption of the resulting precursor fibers was 0.42%.

These fibers were fired in the same manner as in Example 3 to obtain carbon fibers. Their performance is shown in Table 2.

TABLE 1

| | Copolymer composition (wt. %) | Carboxylic acid groups (eq./g) | Sulfate groups and/or sulfonic groups (eq./g) |
|---|---|---|---|
| Example 1 | AN/AAm/MAA/ST-$NH_4$ = 96.1/2.7/0.6/0.6 | $7.0 \times 10^{-5}$ | $3.2 \times 10^{-5}$ |
| Example 2 | AN/AAm/IA/ST-$NH_4$ = 96.0/2.8/0.5/0.7 | $7.6 \times 10^{-5}$ | $3.4 \times 10^{-5}$ |
| Example 3 | AN/AAm/MAA = 96.1/3.2/0.7 | $8.1 \times 10^{-5}$ | $2.8 \times 10^{-5}$ |
| Example 4 | AN/AAm/IA = 96.1/3.2/0.7 | $1.1 \times 10^{-4}$ | $2.9 \times 10^{-5}$ |

In this table, AN represents acrylonitrile; AAm, acrylamide; MAA, methacrylic acid; IA, itaconic acid; and ST-$NH_4$, ammonium styrenesulfonate.

TABLE 2

| | Porosity of coagulated filaments (%) | Iodine adsorption of precursor fibers (%) | Strand performance | |
|---|---|---|---|---|
| | | | Strength ($kg/mm^2$) | Elastic modulus ($tons/mm^2$) |
| Example 1 | 35 | 0.32 | 510 | 26.3 |
| Example 2 | 33 | 0.28 | 505 | 26.1 |
| Example 3 | 32 | 0.35 | 511 | 26.4 |
| Example 4 | 34 | 0.36 | 503 | 26.2 |
| Example 5 | 28 | 0.15 | 550 | 27.3 |
| Example 6 | 35 | 0.23 | 517 | 28.6 |
| Example 7 | 45 | 0.42 | 492 | 25.4 |

EXAMPLE 8

A mixture of specified monomers, distilled water, dimethylacetamide and a polymerization initiator (i.e., azobisisobutyronitrile) was fed to an overflow type polymerization vessel in a fixed amount per minute, during which it was maintained at 65° C. with stirring. The overflowing polymer slurry was washed and dried to obtain an acrylonitrile-based copolymer.

The composition of this copolymer, its content of carboxylic acid groups, and its content of sulfate groups and/or sulfonic groups are shown in Table 3. By controlling the amount of the polymerization initiator, a copolymer having an intrinsic viscosity [η] of 1.7 was obtained. Under the same conditions as employed in Example 1, this copolymer was spun by wet spinning to obtain 1.1 denier precursor fibers.

Subsequently, these precursor fibers were stabilized and carbonized in the same manner as in Example 1. The strand performance of the resulting carbon fibers is shown in Table 4.

TABLE 3

| | Copolymer composition (wt. %) | Carboxylic acid groups (eq./q) | Sulfate groups and/or sulfonic qroups (eq./q) |
|---|---|---|---|
| Example 8 | AN/AAm/MAA/ST-$NH_4$ = 94.2/4.5/0.6/0.7 | $7.0 \times 10^{-5}$ | $3.6 \times 10^{-5}$ |

In this table, AN represents acrylonitrile; AAm, acrylamide; MAA, methacrylic acid; and ST-$NH_4$, ammonium styrenesulfonate.

TABLE 4

| | Porosity of coagulated filaments (%) | Iodine adsorption of precursor fibers (%) | Strand performance | |
|---|---|---|---|---|
| | | | Strength ($kg/mm^2$) | Elastic modulus ($tons/mm^2$) |
| Example 8 | 37 | 0.36 | 454 | 26.3 |

Comparative Examples 1 to 4

Copolymers having an intrinsic viscosity [η] of 1.7 were prepared in the same manner as in Example 8. The composition of each copolymer, its content of carboxylic acid groups, and its content of sulfate groups and/or sulfonic groups are shown in Table 5. Under the same conditions as employed in Example 1, each copolymer was spun by wet spinning to obtain 1.1 denier precursor fibers. Subsequently, these precursor fibers were fired in the same manner as in Example 1. The strand performance of the resulting carbon fibers is shown in Table 6.

TABLE 5

| | Copolymer composition (wt. %) | Carboxylic acid groups (eq./g) | Sulfate groups and/or sulfonic groups (eq./g) |
|---|---|---|---|
| Comparative Example 1 | AN/AAm/MAA/ST-$NH_4$ = 96.1/1.0/2.5/0.4 | $2.9 \times 10^{-4}$ | $2.1 \times 10^{-5}$ |
| Comparative Example 2 | AN/AAm/MAA/ST-Na = 96.1/2.6/0.6/0.7 | $7.0 \times 10^{-5}$ | $3.4 \times 10^{-5}$ |
| Comparative Example 3 | AN/AAm/MAA/ST-$NH_4$ = 96.1/0.5/2.5/0.9 | $2.9 \times 10^{-4}$ | $4.5 \times 10^{-5}$ |
| Comparative Example 4 | AN/AAm/MAA/ST-$NH_4$ = 89.0/3.0/4.0/4.0 | $4.6 \times 10^{-4}$ | $2.0 \times 10^{-4}$ |

In this table, AN represents acrylonitrile; AAm, acrylamide; MAA, methacrylic acid; ST-$NH_4$, ammonium styrenesulfonate; and ST-Na, sodium styrenesulfonate.

TABLE 6

| | Porosity of coagulated filaments (%) | Iodine adsorption of precursor fibers (%) | Strand performance | |
|---|---|---|---|---|
| | | | Strength ($kg/mm^2$) | Elastic modulus ($tons/mm^2$) |
| Comparative Example 1 | 40 | 0.57 | 445 | 26.6 |
| Comparative Example 1 | 35 | 0.36 | 427 | 26.3 |
| Comparative Example 1 | 58 | 0.62 | 430 | 26.1 |

TABLE 6-continued

| | Porosity of coagulated filaments (%) | Iodine adsorption of precursor fibers (%) | Strand performance | |
|---|---|---|---|---|
| | | | Strength ($kg/mm^2$) | Elastic modulus ($tons/mm^2$) |
| Comparative Example 1 | 31 | 0.38 | 350 | 26.2 |

EXAMPLE 9

According to the same polymerization method as described in Example 1, an acrylonitrile-based copolymer having a composition in which AN/AAm/MAA/ST-$NH_4$= 97.9/0.5/0.7/0.9 was prepared. The intrinsic viscosity [η] of this copolymer was 1.7. Moreover, the content of carboxylic acid groups in this acrylonitrile-based copolymer was $8.2\times10^{-5}$ equivalent/g, and the content of sulfate groups and/or sulfonic groups therein was $4.5\times10^{-5}$ equivalent/g.

This acrylonitrile-based copolymer was dissolved in dimethylacetamide to prepare a spinning solution (having a polymer concentration of 21% and a solution temperature of 70° C.).

Using a spinneret having 3,000 holes with a diameter of 0.075 mm, this spinning solution was extruded into an aqueous solution of dimethylacetamide having a concentration of 70% and a bath temperature of 35° C. Thus, there were obtained transparent coagulated filaments free of macrovoids. Their porosity was 58%. Moreover, these coagulated filaments were post-treated in the same manner as in Example 1 to obtain 1.1 denier precursor fibers having a circular cross section. The iodine adsorption of the resulting precursor fibers was 0.35%. However, stable spinning could not be carried out owing to a rise in nozzle pressure with spinning time.

Subsequently, these fibers were fired in the same manner as in Example 1 to obtain carbon fibers. The resulting carbon fibers had a strand strength of 450 $kg/mm^2$ and a strand elastic modulus of 26.7 $tons/mm^2$.

EXAMPLE 10

A mixture of acrylonitrile, methyl acrylate (hereinafter abbreviated as MA), methacrylic acid, distilled water and polymerization initiators (i.e., ammonium persulfate, ammonium hydrogen sulfite and sulfuric acid) was fed to an overflow type polymerization vessel in a fixed amount per minute, during which it was maintained at 50° C. with stirring. The overflowing polymer slurry was washed and dried to obtain an acrylonitrile-based copolymer having a composition in which AN/MA/MAA=96/3/1 (wt. %).

The content of carboxylic acid groups in this acrylonitrile-based copolymer was $1.2\times10^{-4}$ equivalent/g, and the content of sulfate groups and/or sulfonic groups therein was $2.8\times10^{-5}$ equivalent/g. Moreover, the intrinsic viscosity [η] of this copolymer was 1.75.

This acrylonitrile-based copolymer was dissolved in dimethylacetamide to prepare a spinning solution (having a polymer concentration of 21% and a solution temperature of 70° C.).

Using a spinneret having 3,000 holes with a diameter of 0.075 mm, this spinning solution was extruded into an aqueous solution of dimethylacetamide having a concentration of 71% and a bath temperature of 35° C. Thus, there were obtained transparent coagulated filaments free of macrovoids. Their porosity was 62%. Moreover, these coagulated filaments were treated in the same manner as in Example 1 to obtain 1.1 denier precursor fibers having a circular cross section. The iodine adsorption of the resulting precursor fibers was 2.53%.

Subsequently, these fibers were fired in the same manner as in Example 1. The carbon fibers thus obtained had a strand strength of 410 $kg/mm^2$ and a strand elastic modulus of 25.3 $tons/mm^2$.

Comparative Example 5

The copolymer and spinning solution used in this comparative example were similar to those of Example 3. The spinning solution was spun in the same manner as in Example 3, and the resulting coagulated filaments were washed, drawn, treated with a spin finish agents, and densified by drying in the same manner as in Example 3, except that their postdrawing was omitted. Thus, there were obtained 1.1 denier precursor fibers having a circular cross section.

The iodine adsorption of these fibers was determined to be 1.44%.

These fibers were fired in the same manner as in Example 3 to obtain carbon fibers. The carbon fibers thus obtained had a strand strength of 440 $kg/mm^2$ and a strand elastic modulus of 26.3 $tons/mm^2$.

Comparative Example 6

A mixture of AN, AAm, MAA, distilled water and a polymerization initiator (i.e., azobisisobutyronitrile) was fed to an overflow type polymerization vessel in a fixed amount per minute, during which it was maintained at 65° C. with stirring. The overflowing polymer slurry was washed and dried to obtain an acrylonitrile-based copolymer containing $7.8\times10^{-5}$ equivalent/g of carboxylic acid groups but containing neither sulfate group nor sulfonic group. Its composition was such that AN/AAm/MAA=96.1/3.2/0.7 (wt. %). Moreover, the intrinsic viscosity [η] of this copolymer was 1.73.

This acrylonitrile-based copolymer was dissolved in dimethylacetamide to prepare a spinning solution (having a polymer concentration of 21% and a solution temperature of 70° C.).

Using a spinneret having 3,000 holes with a diameter of 0.075 mm, this spinning solution was extruded into an aqueous solution of dimethylacetamide having a concentration of 70% and a bath temperature of 35° C., and taken up at a speed of 8 m per minute to obtain coagulated filaments. When the lateral surfaces of these coagulated filaments were observed under an optical microscope, a large number of macrovoids were detected within the filaments. These coagulated filaments were post-treated in the same manner as in Example 1 to obtain 1.1 denier precursor fibers having a circular cross section.

Subsequently, these fibers were fired in the same manner as in Example 1. The resulting carbon fibers had a strand strength of 385 $kg/mm^2$ and a strand elastic modulus of 25.3 $tons/mm^2$.

Comparative Example 7

The polymer obtained in Example 3 was dissolved in dimethylacetamide to prepare a spinning solution (having a polymer concentration of 21%).

Using a spinneret having 3,000 holes with a diameter of 0.075 mm, this spinning solution was extruded into an aqueous solution of dimethylacetamide having a concentration of 70% and a bath temperature of 35° C., and taken up at a speed of 8 m per minute to obtain coagulated filaments. When the lateral surfaces of these coagulated filaments were observed under an optical microscope, a large number of macrovoids were detected within the filaments at a density far exceeding one macrovoid per millimeter.

Comparative Example 8

The spinning solution used in this comparative example was similar to that of Comparative Example 7. Using a spinneret having 3,000 holes with a diameter of 0.075 mm, this spinning solution was extruded into an aqueous solution of dimethylacetamide having a concentration of 50% and a bath temperature of 35° C., and taken up at a speed of 8 m per minute to obtain coagulated filaments. When the lateral surfaces of these coagulated filaments were observed under an optical microscope, no macrovoid was detected. However, the coagulated filaments were whitened (devitrified) and had a kidney-shaped cross section.

EXAMPLE 11

A copolymer [AN/AAm/MAA=96.5/2.5/1.0 (%)] was prepared by carrying out polymerization in the same manner as in Example 3. Its content of carboxylic acid groups was $1.2\times10^{-4}$ equivalent/g, and its content of sulfate groups and/or sulfonic groups was $2.7\times10^{-5}$ equivalent/g. This copolymer was spun, stabilized and carbonized in the same manner as in Example 1. The resulting coagulated filaments were transparent and free of macrovoids. The resulting precursor fibers had a circular cross section, and their iodine adsorption was 0.29%. The porosity of the coagulated filaments was 33%. Moreover, the strand performance of the resulting carbon fibers was characterized by a strength of 507 kg/mm$^2$ and an elastic modulus of 26.2 tons/mm$^2$.

EXAMPLE 12

A copolymer (AN/AAm/MAA=97.5/1.5/1.0) was prepared by carrying out polymerization in the same manner as in Example 3. Its content of carboxylic acid groups was $1.2\times10^{-4}$ equivalent/g, and its content of sulfate groups and/or sulfonic groups was $2.8\times10^{-5}$ equivalent/g. This copolymer was spun and fired in the same manner as in Example 1. The resulting coagulated filaments were transparent and free of macrovoids. The resulting precursor fibers had a circular cross section, and their iodine adsorption was 0.38%. The porosity of the coagulated filaments was 34%. Moreover, the strand performance of the resulting carbon fibers was characterized by a strength of 504 kg/mm$^2$ and an elastic modulus of 26.3 tons/mm$^2$.

EXPLOITABILITY IN INDUSTRY

According to the present invention, there are provided acrylonitrile-based precursor fibers for the formation of carbon fibers which, as a result of densification and homogenization of the fiber structure, can easily yield carbon fibers having a high strength and a high elastic modulus, as well as a highly economical process for preparing the same. When these acrylonitrile-based precursor fibers for the formation of carbon fibers are flameproofed and then carbonized, the resulting carbon fibers exhibit excellent performance.

Figure 1:
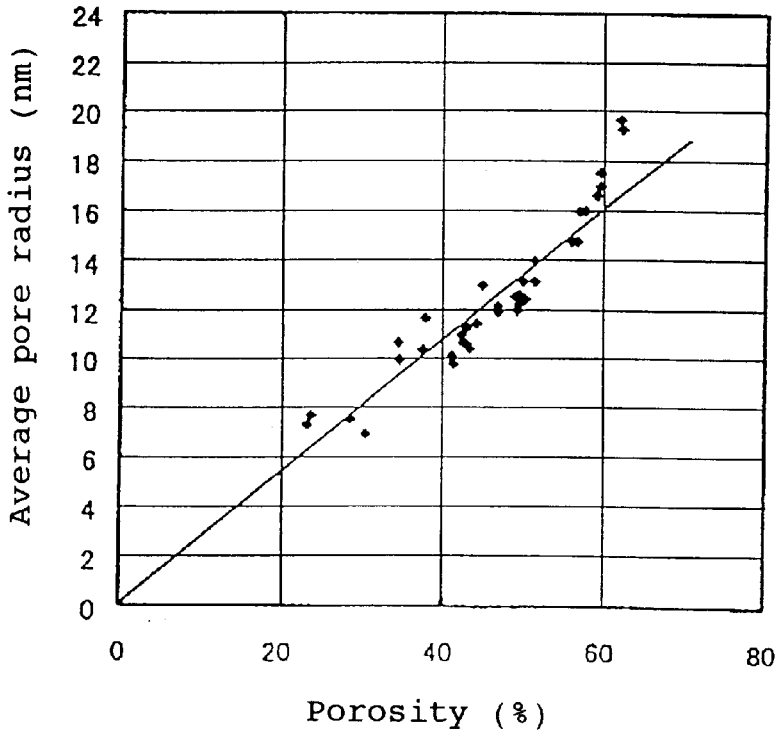
FIG. 1 is a graph showing the relationship between the porosity and average pore radius of coagulated filaments.

What is claimed is:

1. An acrylonitrile-based precursor fiber for the formation of a carbon fiber which is obtained by spinning an acrylonitrile-based copolymer to form a coagulated filament, and treating the coagulated filament, wherein said acrylonitrile-based copolymer is a copolymer containing not less than 90% by weight of acrylonitrile units as monomeric components, containing $5.0\times10^{-5}$ to $2.0\times10^{-4}$ equivalent/g of carboxylic acid groups and not less than $0.5\times10^{-5}$ equivalent/g of sulfate groups and/or sulfonic groups, and having protons and/or ammonium ions as counter ions to the carboxylic acid groups, sulfate groups and sulfonic groups; and the amount of iodine adsorbable to the acrylonitrile-based precursor fiber for the formation of a carbon fiber is not greater than 0.8% by weight based on the weight of the fiber.

2. An acrylonitrile-based precursor fiber for the formation of a carbon fiber as claimed in claim 1 wherein said acrylonitrile-based copolymer contains not less than 1.0% by weight of acrylamide units.

3. An acrylonitrile-based precursor fiber for the formation of a carbon fiber as claimed in claim 1 wherein said acrylonitrile-based copolymer contains not less than 96% by weight of acrylonitrile units.

4. An acrylonitrile-based precursor fiber for the formation of a carbon fiber as claimed in claim 1 wherein said acrylonitrile-based copolymer contains not less than $1.0\times10^{-5}$ equivalent/g of sulfate groups and/or sulfonic groups.

5. An acrylonitrile-based precursor fiber for the formation of a carbon fiber as claimed in claim 1 wherein said acrylonitrile-based copolymer has sulfate groups and/or sulfonic groups at polymer ends.

6. An acrylonitrile-based precursor fiber for the formation of a carbon fiber as claimed in claims 5 wherein said acrylonitrile-based copolymer is such that the sulfate groups and/or sulfonic groups present at polymer ends are derived from a persulfate/sulfite initiator used as the polymerization initiator, and/or ammonium salts thereof.

7. An acrylonitrile-based precursor fiber for the formation of a carbon fiber as claimed in claim 1 wherein said coagulated filament has a porosity of not greater than 50%.

8. An acrylonitrile-based precursor fiber for the formation of a carbon fiber as claimed in claim 2 wherein said coagulated filament has a porosity of not greater than 50%.

9. An acrylonitrile-based precursor fiber for the formation of a carbon fiber as claimed in claim 3 wherein said coagulated filament has a porosity of not greater than 50%.

10. An acrylonitrile-based precursor fiber for the formation of a carbon fiber as claimed in claim 1 wherein the fiber has a substantially circular cross section.

11. An acrylonitrile-based precursor fiber for the formation of a carbon fiber as claimed in claim 2 wherein the fiber has a substantially circular cross section.

12. An acrylonitrile-based precursor fiber for the formation of a carbon fiber as claimed in claim 3 wherein the fiber has a substantially circular cross section.

13. An acrylonitrile-based precursor fiber for the formation of a carbon fiber as claimed in claim 1 wherein said coagulated filament contains less than one macrovoid in a 1 mm length of said coagulated filament.

14. An acrylonitrile-based precursor fiber for the formation of a carbon fiber as claimed in claim 2 wherein said coagulated filament contains less than one macrovoid in a 1 mm length of said coagulated filament.

15. An acrylonitrile-based precursor fiber for the formation of a carbon fiber as claimed in claim 3 wherein said coagulated filament contains less than one macrovoid in a 1 mm length of said coagulated filament.

16. A process for preparing an acrylonitrile-based precursor fiber for the formation of a carbon fiber which comprises the steps of:

providing a spinning solution comprising an acrylonitrile-based copolymer dissolved in a solvent, said acrylonitrile-based copolymer containing not less than 90% by weight of acrylonitrile units as monomeric components, containing $5.0\times10^{-5}$ to $2.0\times10^{-4}$ equivalent/g of carboxylic acid groups and not less than $0.5\times10^{-5}$ equivalent/g of sulfate groups and/or sulfonic groups, and having protons and/or ammonium ions as counter ions to the carboxylic acid groups, sulfate groups and sulfonic groups;

extruding the spinning solution into a coagulating bath to form a coagulated filament, or extruding the spinning solution into air and then passing it through a coagulating bath to form a coagulated filament;

washing the coagulated filament, drawing it, and densifying it by drying; and drawing the densified filament again.

17. A process for preparing an acrylonitrile-based precursor fiber for the formation of a carbon fiber as claimed in claim 16 wherein said solvent is dimethylacetamide and said coagulating bath is an aqueous solution containing dimethylacetamide.

18. A process for preparing an acrylonitrile-based precursor fiber for the formation of a carbon fiber as claimed in claim 16 wherein the concentration of dimethylacetamide in said coagulating bath is in the range of 60 to 75% by weight.

19. The carbon fiber formed by stabilizing and carbonizing an acrylonitrile-based precursor fiber for the formation of a carbon fiber as claimed in claim 1.

20. The carbon fiber formed by stabilizing and carbonizing an acrylonitrile-based precursor fiber for the formation of a carbon fiber as claimed in claim 2.

21. The carbon fiber formed by stabilizing and carbonizing an acrylonitrile-based precursor fiber for the formation of a carbon fiber as claimed in claim 3.

22. The carbon fiber formed by stabilizing and carbonizing an acrylonitrile-based precursor fiber for the formation of a carbon fiber as claimed in claim 7.

23. The carbon fiber formed by stabilizing and carbonizing an acrylonitrile-based precursor fiber for the formation of a carbon fiber as claimed in claim 10.

24. The carbon fiber formed by stabilizing and carbonizing an acrylonitrile-based precursor fiber for the formation of a carbon fiber as claimed in claim 13.

* * * * *

UNITED STATES PATENT AND TRADEMARK OFFICE

CERTIFICATE OF CORRECTION

PATENT NO. : 6,326,451 B1
DATED : December 4, 2001
INVENTOR(S) : Hamada et al.

It is certified that error appears in the above-identified patent and that said Letters Patent is hereby corrected as shown below:

Title page, item [54], and Column 1, line 1,
The title should be:

-- [54] ACRYLONITRILE-BASED PRECURSOR FIBER FOR THE FORMATION OF CARBON FIBER, PROCESS FOR PREPARING SAME, AND CARBON FIBER FORMED FROM SAME --

Signed and Sealed this

Nineteenth Day of March, 2002

*Attest:*

*Attesting Officer*

JAMES E. ROGAN
*Director of the United States Patent and Trademark Office*